US011725849B2

(12) United States Patent
Blichmann

(10) Patent No.: US 11,725,849 B2
(45) Date of Patent: Aug. 15, 2023

(54) BOILER APPARATUS AND METHOD THEREOF

(71) Applicant: Blichmann Engineering, LLC, Lafayette, IN (US)

(72) Inventor: John Blichmann, Lafayette, IN (US)

(73) Assignee: BLICHMANN ENGINEERING, LLC, Lafayette, IN (US)

( * ) Notice: Subject to any disclaimer, the term of this patent is extended or adjusted under 35 U.S.C. 154(b) by 0 days.

(21) Appl. No.: 17/963,166

(22) Filed: Oct. 10, 2022

(65) Prior Publication Data

US 2023/0036844 A1 Feb. 2, 2023

Related U.S. Application Data

(63) Continuation of application No. 16/588,908, filed on Sep. 30, 2019, now Pat. No. 11,466,898.

(60) Provisional application No. 62/738,125, filed on Sep. 28, 2018.

(51) Int. Cl.

| | |
|---|---|
| ***F24H 9/1818*** | (2022.01) |
| ***F24H 1/20*** | (2022.01) |
| ***F24H 1/22*** | (2022.01) |
| ***F24H 1/50*** | (2022.01) |
| ***F24H 9/00*** | (2022.01) |

(52) U.S. Cl.

CPC ..... *F24H 9/1818* (2013.01); *F24H 1/202* (2013.01); *F24H 1/22* (2013.01); *F24H 1/50* (2013.01); *F24H 9/0005* (2013.01); *F24D 2200/08* (2013.01)

(58) Field of Classification Search

CPC ..... F24H 9/1818; F24H 9/0005; F24H 1/202; F24H 1/22; F24H 1/50; F24D 2200/08; H05B 3/681; A47J 27/21041

See application file for complete search history.

(56) References Cited

U.S. PATENT DOCUMENTS

| | | | | |
|---|---|---|---|---|
| 2,863,037 | A * | 12/1958 | Johnstone | A47J 36/2466 165/135 |
| 4,594,801 | A * | 6/1986 | Gronwick | D06F 75/18 219/250 |
| 6,310,329 | B1 * | 10/2001 | Carter | A47J 36/2461 219/442 |
| 9,801,482 | B1 * | 10/2017 | Alexander | H05B 1/0244 |
| 2014/0234482 | A1 * | 8/2014 | Kempfert | C12C 13/10 99/278 |
| 2017/0095749 | A1 * | 4/2017 | Sammons | B01D 3/003 |

* cited by examiner

*Primary Examiner* — Steven S Anderson, II

(74) *Attorney, Agent, or Firm* — Gutwein Law; Tyler B. Droste

(57) ABSTRACT

An improved boiler apparatus having multiple resistive heating elements are provided with fixed resistances that can be rewired to allow dual voltage capability and at the same time, reduced watt density. For 120V operation, the large diameter 9-ohm coil is used alone to provide the lowest possible watt density. For 240V operation, all three heating coils are wired in series, creating a low watt density but high wattage heater.

19 Claims, 11 Drawing Sheets

BOILER APPARATUS AND METHOD THEREOF

CROSS-REFERENCE TO RELATED APPLICATION

This U.S. Continuation-In-Part Patent application claims priority to U.S. patent application Ser. No. 16/588,908 filed Sep. 30, 2019, which claims priority to Provisional Application 62/738,125 filed Sep. 28, 2018, the disclosure of which is considered part of the disclosure of this application and is hereby incorporated by reference in its entirety.

FIELD OF THE INVENTION

This invention relates generally to electric heating elements and boilers.

BACKGROUND

It is known is well known in the home beer brewing art to boil beer for sterilization, isomerization of the hops and other beneficial results. In addition, it is desired by the market to use convenient electric heating for such boilers as it produces no hazardous fumes and excessive heat that propane and natural gas burners used as heat sources do. Large electric coffee urns are known in the art to use for such a boiler. These current art urns are single voltage designs that are either 120V or 240V. The limitations of 120V is that only 15 A receptacles are available in most homes limiting max power to about 1500 W. Subsequently heating times are excessively long, and the boil intensity is very low leading to undesirable flavors in the finished beer such as dimethyl sulfide (DMZ). However, 240V units can reach 2500 W or more creating fast heating times and excellent boil intensity. Most homes have access to 240V power through the main power panel, dryers, ovens etc. But it may be located in an inconvenient area for brewing.

As urns are normally heating water for coffee and tea, watt density is not an issue. For beer brewing, the sugars will scorch if the watt density is too high and this, in turn, will caramelize (discolor) and alter the flavor in an undesirable way. Therefore, it is an object of this invention to allow dual voltage capability without changing the heating elements. It is a second objective of this product to reduce the effective watt density to greatly reduce the chances of scorching.

BRIEF SUMMARY OF THE INVENTION

In one aspect, this disclosure is related to an improved boiler apparatus including a kettle portion and a heating element portion. The kettle portion can include an interior, an exterior surface, a bottom end and a top end. The heating element portion can include a heating element assembly comprising a first coil having a first diameter and a first resistance coupled to a sub plate, a control panel, a switch configured to adjust the voltage supplied to the heating element assembly from a first voltage to a second voltage, wherein the heating element assembly is coupled to the bottom end of the kettle portion.

In another aspect, this disclosure is related to an improved boiler apparatus. The boiler apparatus can include a kettle portion having an interior, an exterior surface, a bottom end having a bottom surface and a top end. The kettle portion can be removably couple to a base portion. The base portion can include an enclosure having a receptacle member, an insulation member for insulating the interior cavity of the enclosure from a heating element, and a heating element assembly comprising a coil having a first diameter and a first resistance that can be coupled to the bottom end of the kettle portion, and a thermostat. The improved boiler apparatus can further include a control panel communicatively coupled to a heating coil and thermostat. In some embodiments, a switch can be communicatively coupled to the heating coil, wherein the switch is configured to adjust the voltage supplied to the heating element assembly from a first voltage to a second voltage, wherein the base portion can be coupled to the bottom end of the kettle portion and rotatable around the kettle to provide multiple orientations of the receptacle with respect to the control panel.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
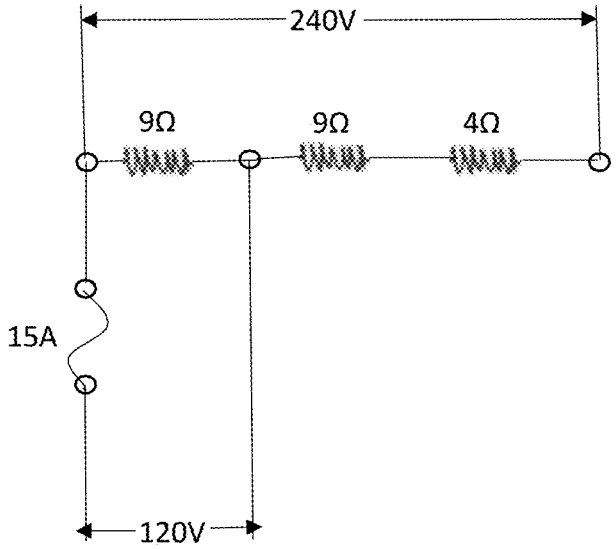
FIG. 1 is a schematic of an exemplary resistive heating element having dual voltage capability of the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the term "coupled" means the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 3:
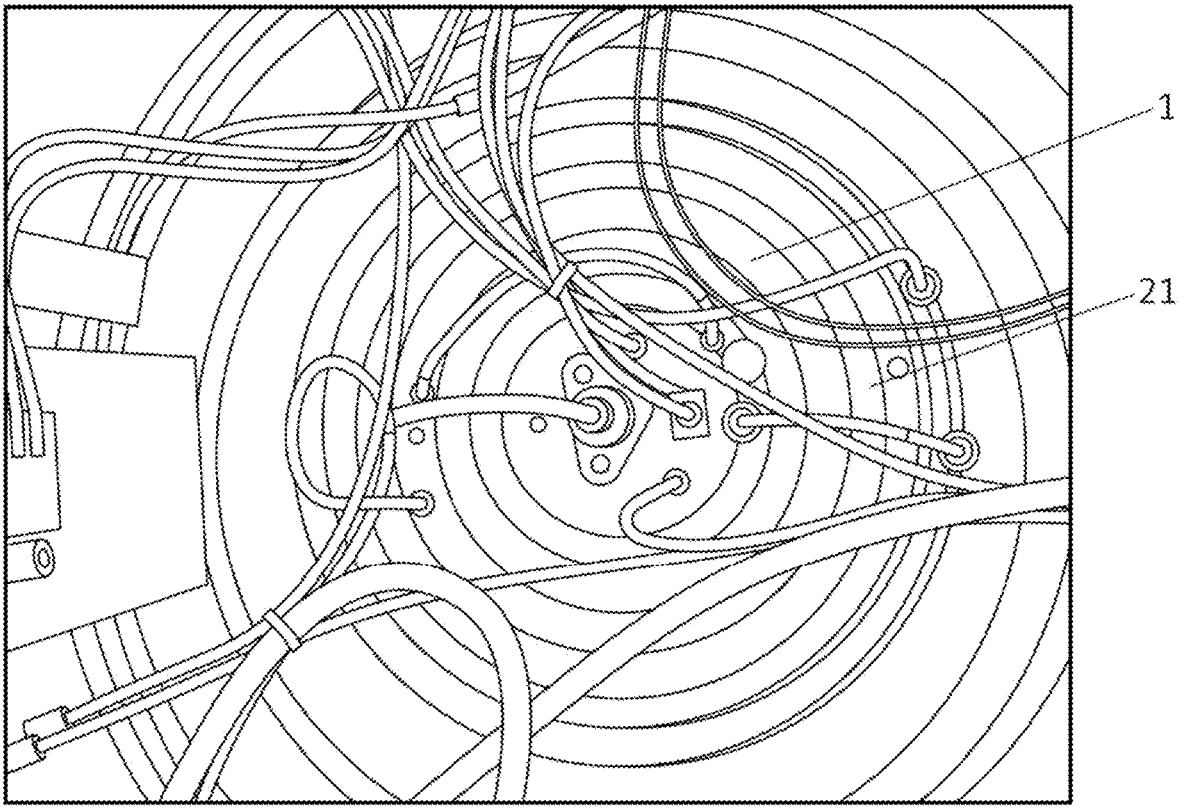
FIG. 3 is an illustration of an exemplary embodiment of a heating element assembly having plurality of coils.

As shown in FIG. 1, a heating element assembly can include multiple resistive heating elements are provided with fixed resistances that can be rewired to allow dual voltage capability, such as 120 v and 240 v operations, and at the same time, reduced watt density. Any number of heating element coils can be used. In some embodiments, the heating element assembly can include a first coil 3 and a second coil 5. In one exemplary embodiment, the heating element 1 can have about 3 individual coil heating elements, including a first coil 3, a second coil 5, and a third coil 7. The first coil can have a first diameter and a first resistance, the second coil can have a second diameter and a second resistance, and the third coil can have a third diameter and a third resistance. In some exemplary embodiments, the first diameter is less than the second diameter. In some exemplary embodiments, the second coil and third coil can have the same resistance. In some embodiments, the first coil can have a lower resistance than the second coil and third coil. In one exemplary embodiment, third coil can have a diameter of about 150 mm and a resistance of about 9 ohms, the second coil can have a diameter of about 110 mm and a resistance of about 9 ohms, and the first coil can have a diameter of about 60 mm and a resistance of about 4 ohms. The three coils can have various resistances and diameters depending upon the applications and input voltage. For 120V operation, the coil 7 can have a larger diameter can be about a 9-ohm coil, which may be used alone to provide the lowest possible watt density for a user's desired application. For 240V operation, all three heating coils can be wired in series, as shown in FIG. 3, creating a low watt density but high wattage heater. A switch 11 can be used to allow a user to quickly convert from 120V to 240V operation.

Figure 2A:
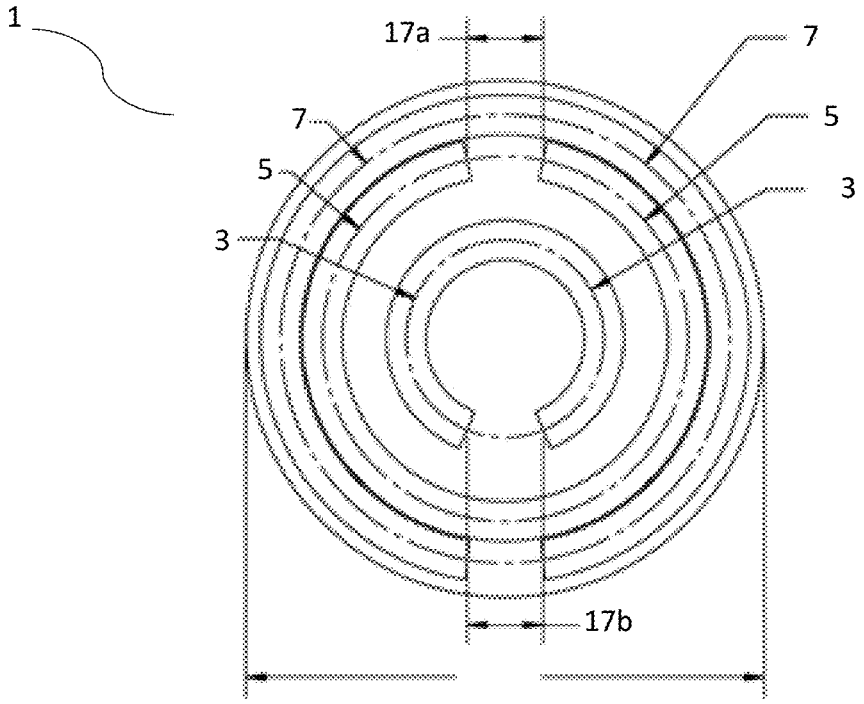
FIG. 2A is an illustration of a top view of an exemplary embodiment of a heating element assembly having plurality of coils.
Figure 2B:
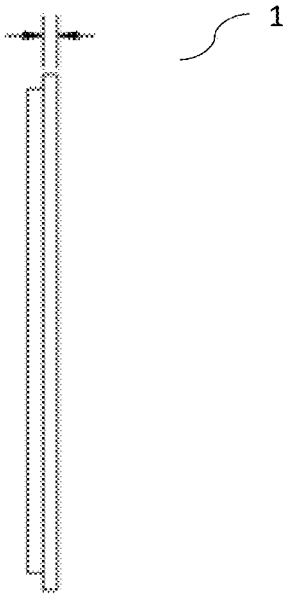
FIG. 2B is an illustration of side view of an exemplary embodiment of a heating element assembly having plurality of coils.
Figure 2C:
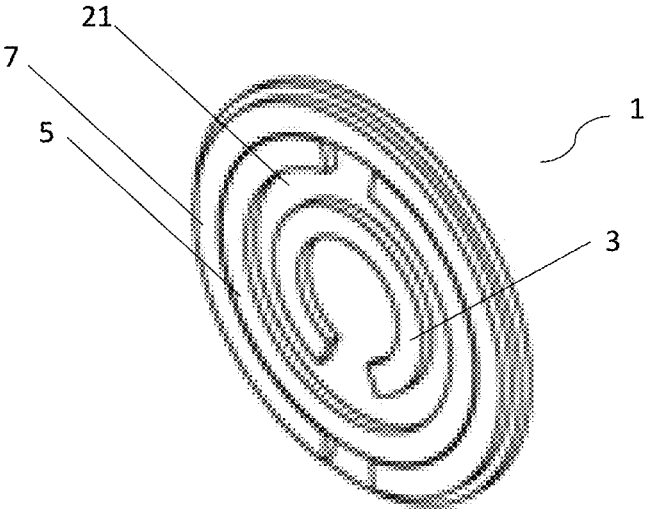
FIG. 2C is an illustration of a perspective view of an exemplary embodiment of a heating element assembly having plurality of coils.

As shown in FIG. 2-3, the heating elements can be designed with space between them so that the heat can spread out over the aluminum sub plate 21 that the elements are bonded to. This aluminum plate/heater assembly 1 can be bonded to the bottom side 13 of the bottom end 23 of an urn or kettle 15. Prior art units used a thin aluminum bonding plate (approx. 1 mm). One exemplary embodiment of the present invention can utilize a very thick plate 1 about 3 to about 10 mm or about 4 to about 6 mm or about 5 mm thick (FIG. 2*b*) to allow the heat to spread to a larger area on the bottom side 13 of the urn 15. In addition, the element electrical connection ends 17*a,b* can be alternated about 180 degrees to allow the heat to spread more evenly on the aluminum plate.

Figure 4:
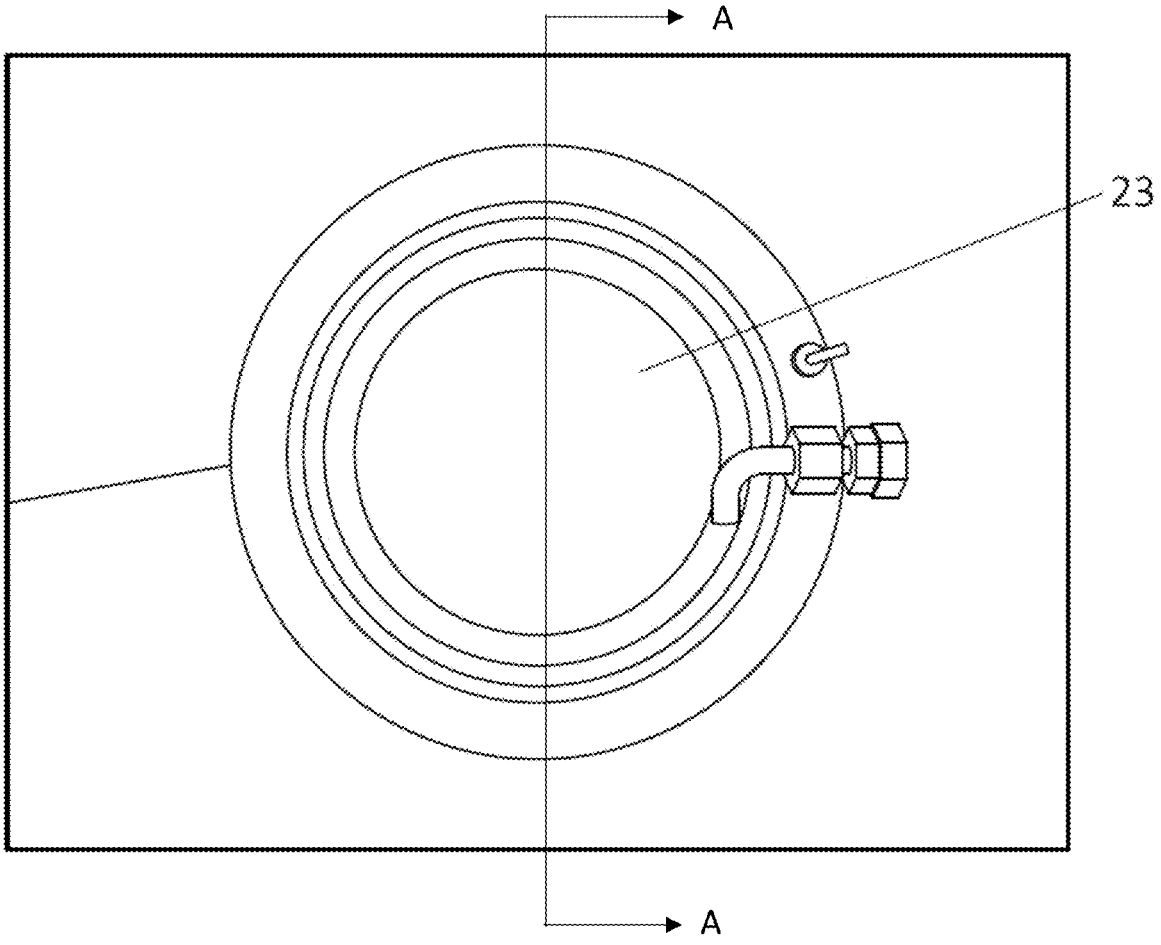
FIG. 4 is an illustration of an interior view of the kettle portion of the present disclosure.
Figure 5:
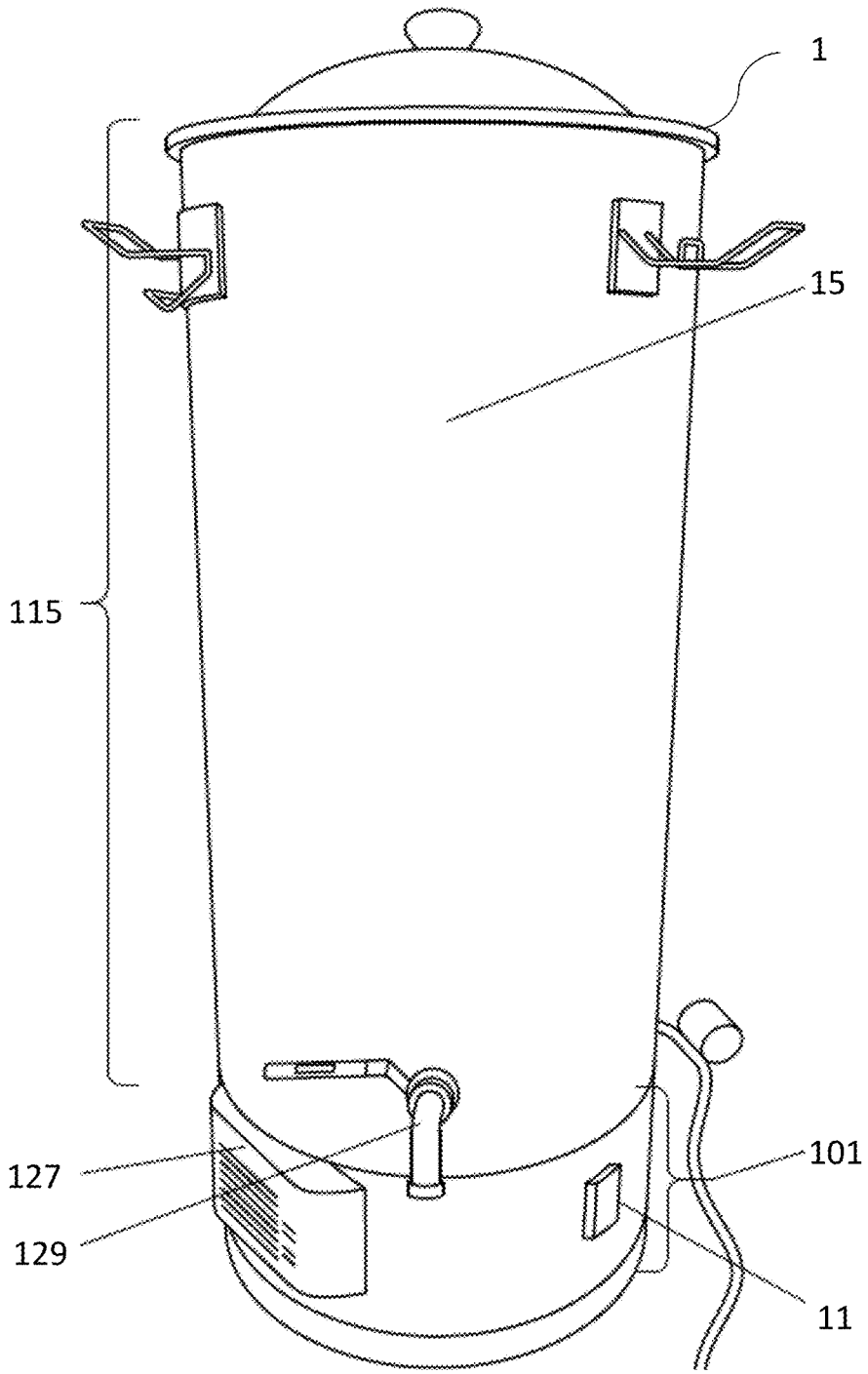
FIG. 5 is an illustration of a perspective view of an improved boiler apparatus of the present disclosure.

FIGS. 4-5 are images of exemplary embodiments of a boiler apparatus 100 of the present disclosure. The boiler apparatus can include a kettle portion 115 and a heating element portion 101. The heating element portion 101 can include the various heating elements and coils as well as the circuitry connecting the various coils. The heating element portion can also include a control panel 127, wherein the control panel 127 is communicatively coupled to the heating element 1 and coils and can be configured to control the amount of voltage being applied to the heating coil 1. A switch 11 can also be included in the heating element portion 101 to allow a user to toggle between two different voltages. The switch can optionally be communicatively coupled to the control panel 127. The control panel can further include wireless technology, such as a transceiver to allow user to communicated to the control panel using any suitable wireless communication. In some exemplary embodiments, the voltages can be 120 v and 240 v. The kettle portion 115 can include one or more valves 129 fluidly connected to the interior of the kettle 15.

Figure 6:
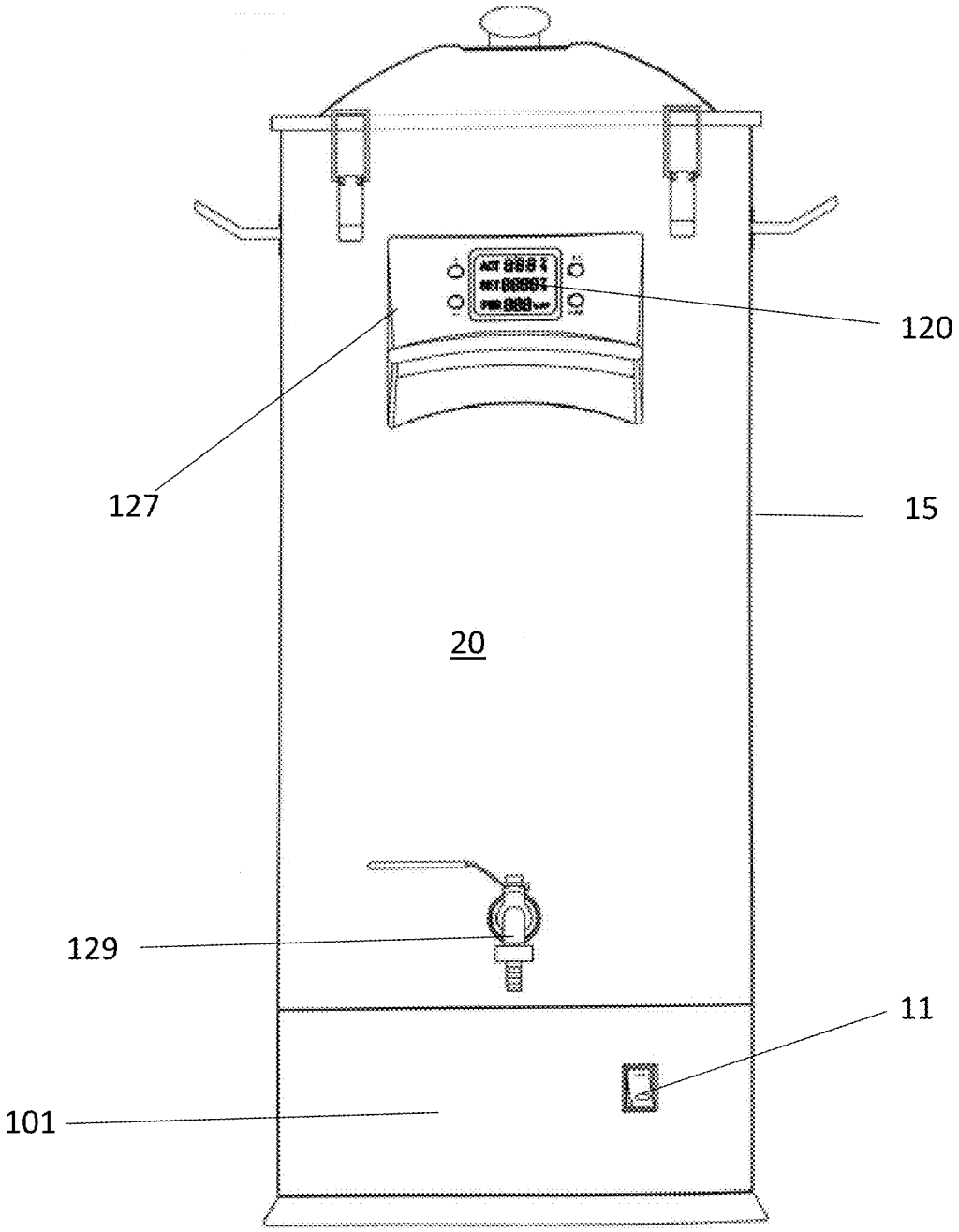
FIG. 6 is an illustration of a perspective view of an improved boiler apparatus of the present disclosure.

As shown in FIG. 6, some exemplary embodiments of the present disclosure related to an all-in-one brewing system can include heating elements to be used as a kettle during the brewing process or other heating processes. The kettle can have a control panel 127 mounted on the exterior wall 20 of the kettle 15. The control panel can include a user interface/display 120 that can display various information including temperature settings, timer, voltage, among other information that a user may need to setup for various tasks including but not limited to a brewing cycle. The apparatus can be used for any suitable heating processes including brewing beer, coffee, distillation, or other processes requiring the heating of water or other liquids. The user interface can be located in any suitable location. In another exemplary embodiment, the control panel 120 can be coupled to the base portion 101.

Figure 7:
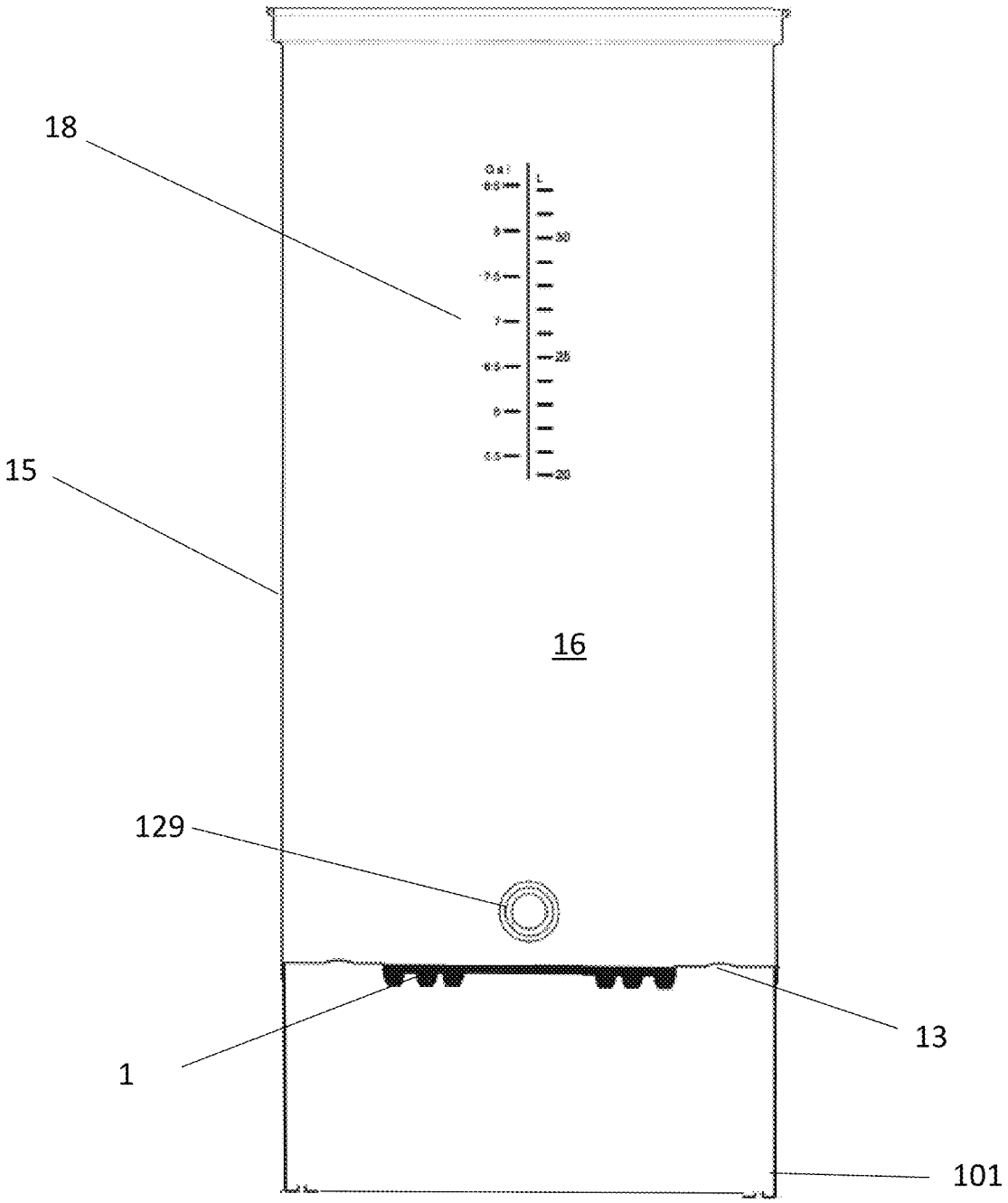
FIG. 7 is an illustration of a cross section view of FIG. 6 providing a fluid level scale on the interior side wall of the kettle.

FIG. 7 provides an interior cross-section view of an improved brewing apparatus of the present disclosure along axis A-A. The interior wall 16 of the kettle 15 can include a liquid level measurement ruler 18 or markings to provide a user easy indication of the amount/volume of liquid that is placed within the interior portion of the kettle. The measurement ruler 18 can be coupled to the interior wall using any suitable means including but not limited to engraving, etching, painting, adhesive, or any other means to the sidewall 18. A heating element 1 can be coupled to the base plate or bottom side 13 of the kettle 15. The heating element 1 can be coupled to a base plate or bottom of the kettle using any suitable means, including but not limited to mechanical fasteners. In some exemplary embodiments, the base plate or kettle bottom can be welded, physically bonded or incorporated into the baseplate or bottom of the kettle 15 to further ensure more uniform heating along the base of the kettle 15.

The heating element 1 and or coil can have a uniform resistance per inch, which can keep the watt density consistent. In some exemplary embodiments, the resistance per inch can vary along the coil. In exemplary embodiments, where a heating element coil 1 is bonded directly to the bottom end 23 of a traditional boil kettle 15. In some exemplary embodiment, the heating element 1 can be permanently bonded to bottom 13 of the kettle. Alternative embodiments can include a removable couple heating element 1 to allow for easy replacement in the event of a heating coil 1 failure. The heating element can additionally include a power connector with a removable connection to the bottom side 13 of the kettle 15. The heating coil 1 can have a spiral design that is continuous with less interconnect wiring and more surface utilized to minimize watt density.

Figure 8:
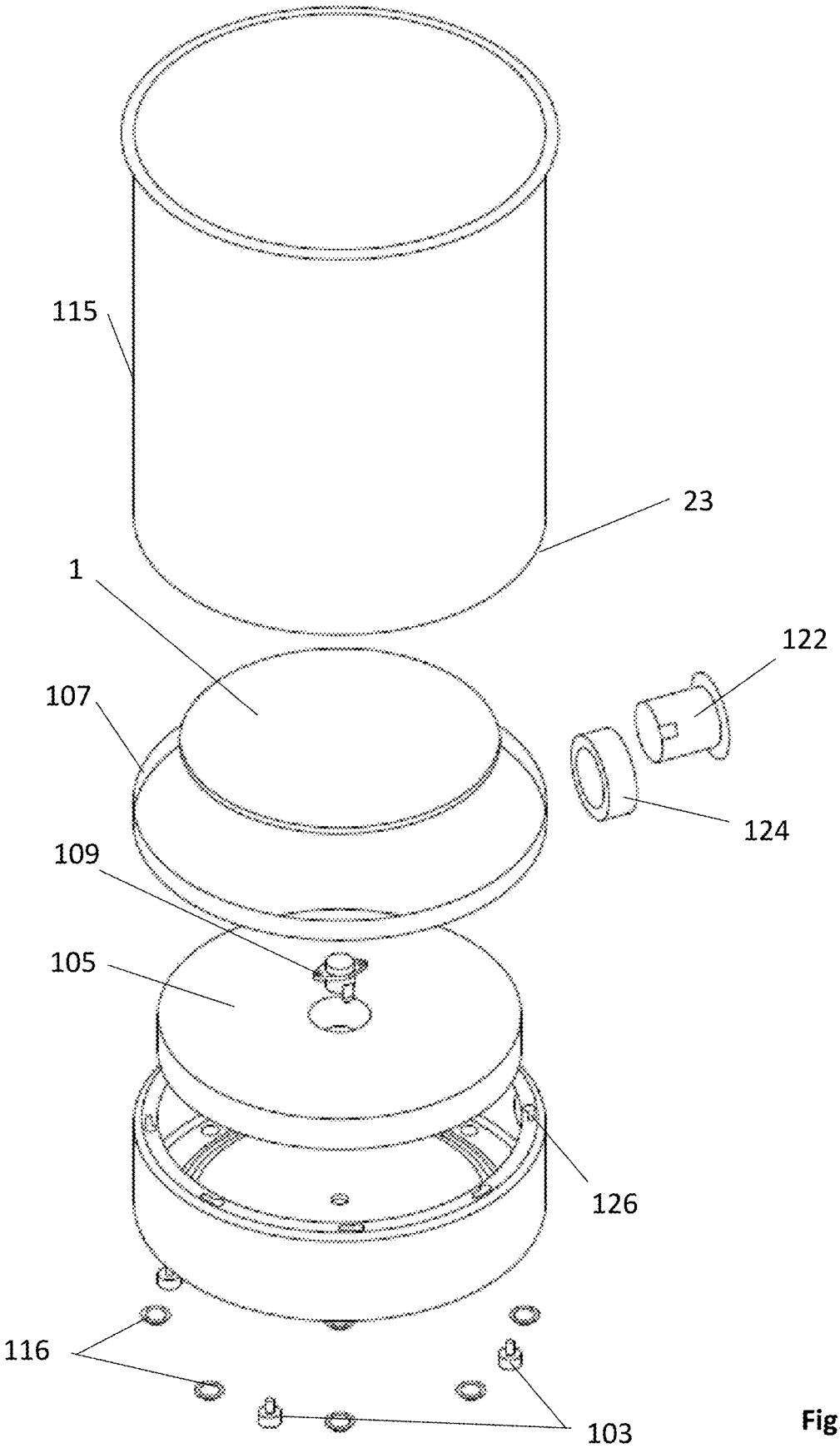
FIG. 8 is an illustration of an exploded view of an exemplary embodiment of an improved boiler apparatus of the present disclosure.

As shown in FIG. 8, an improved brewing apparatus of the present disclosure can include the kettle portion 115 which can have the heating element 1 of the heating element portion 101 bonded to the bottom of the kettle 15 of the kettle portion. In some exemplary embodiments, the heating element portion 101 can include a housing member 103 that can function as the base of the apparatus, as well as house and provide a barrier between the exterior of the apparatus and the heating coil 1. The housing can further include insulation 105 that can additionally reduce heat from escaping the bottom portion 101 of the apparatus and increase efficiency of the heating coil 1 when in operation and further maintain an ideal temperature. A bottom portion sealing band 107 that can provide a seal between the kettle portion 115 and the base portion 101 of the apparatus. A thermostat 109 can additionally be included and communicatively coupled to the controller/control panel 127 of the apparatus. The thermostat 109 can be used to ensure that the temperature is being consistently maintained at the desire temperature of the user.

Figure 9A:
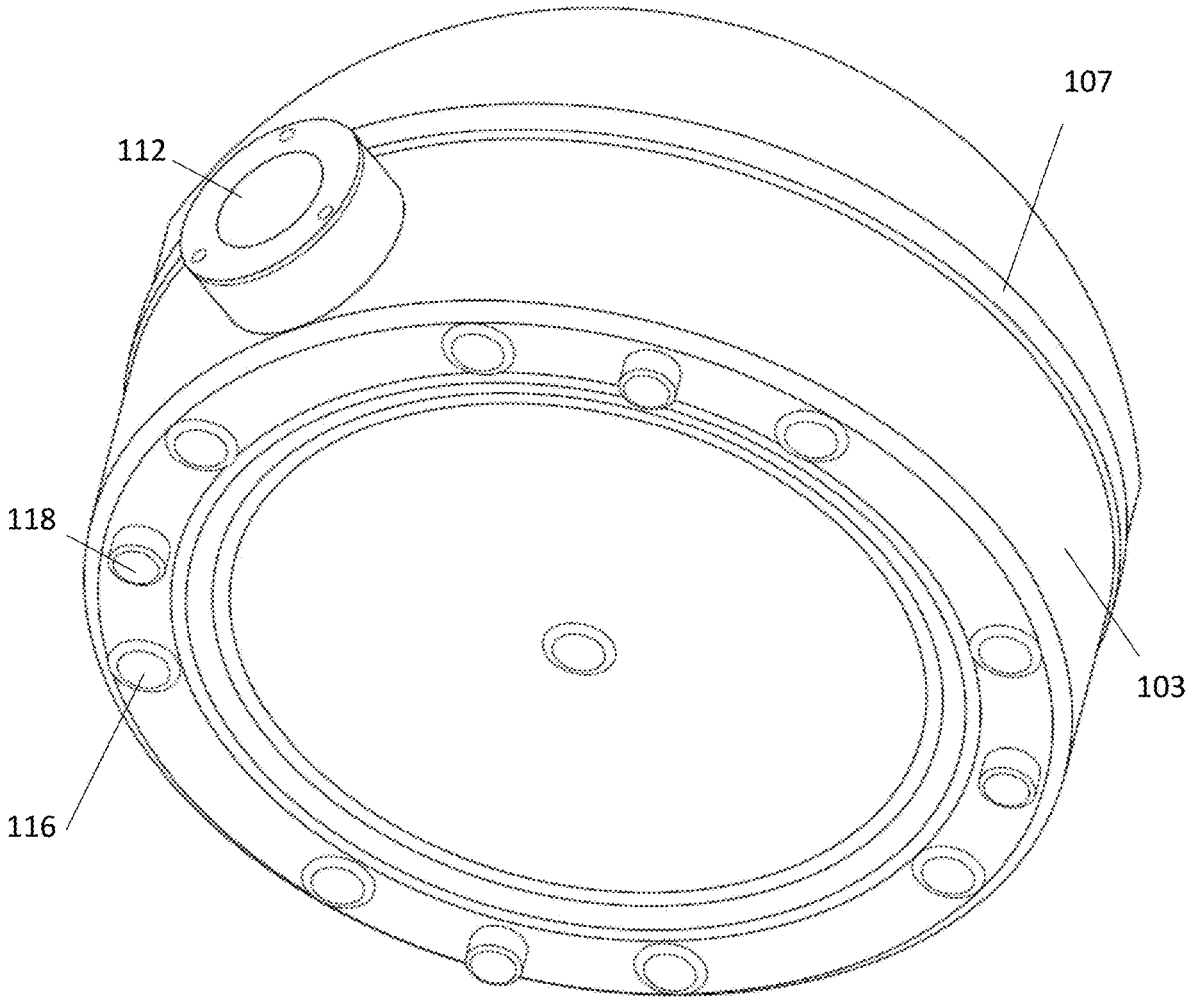
FIG. 9A is an illustration of a perspective view of the bottom portion of an exemplary embodiment of an improved boiler apparatus of the present disclosure.

The housing 101 can additionally include one or more apertures 111 that can be plugged with any suitable means, including a hole plug 116 or a foot 118 member to provider further stability to the base of the apparatus as shown in FIG. 9A. The apertures can allow a user to access the coupling members 128 that connect the base portion 101 to the kettle portion 115. The coupling members 128 can be any suitable means including but not limited to removable fasteners. Once a user tightens or loosens the fasteners the aperture can then be plugged to ensure that debris does not get into the housing 103 of the base portion. The housing 103 can further include a receptable 122 to allow a user to easily plug in the apparatus to a power source. The receptable 122 can have a portion covered by a saddle cover 124.

Figure 9B:
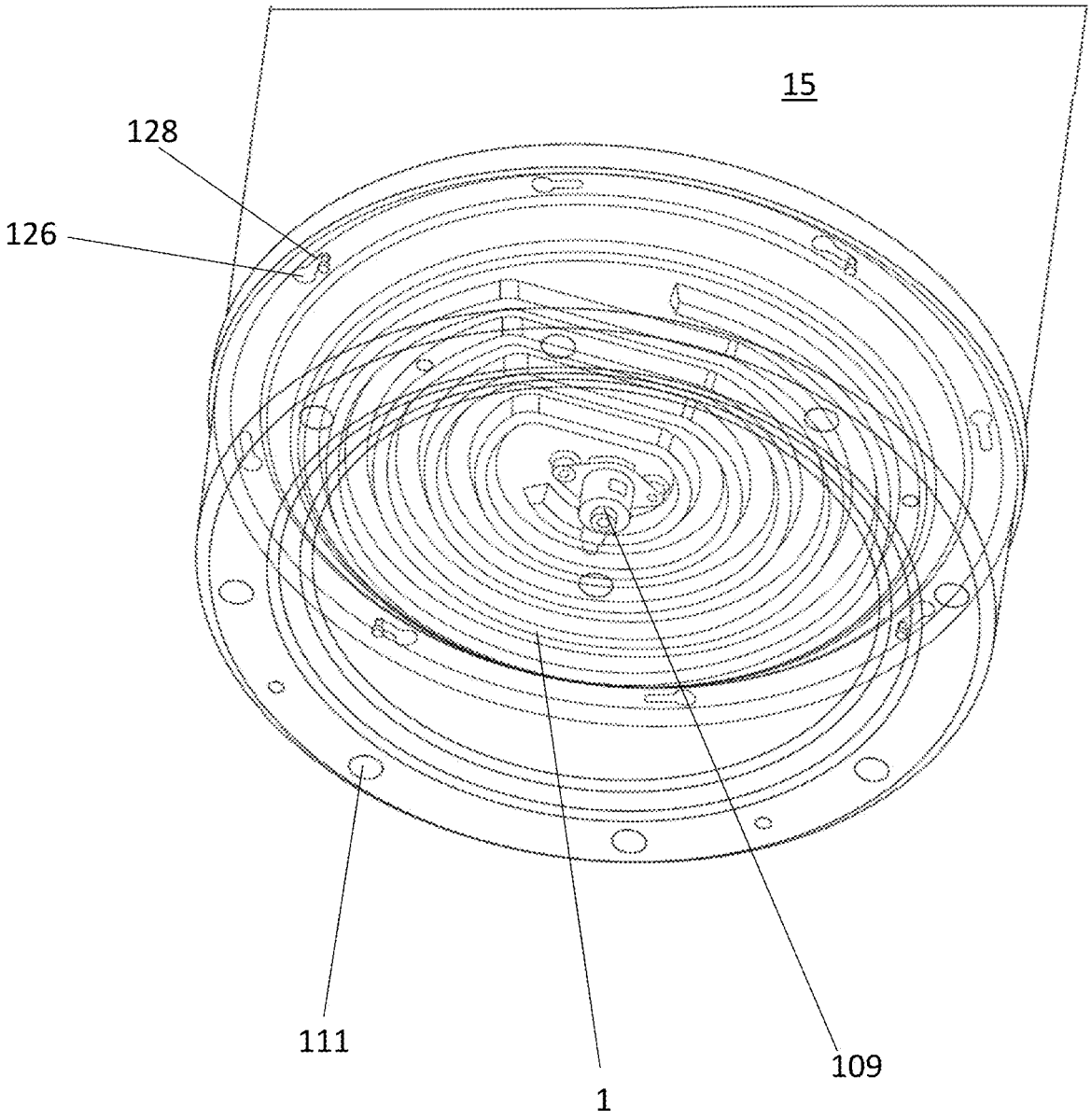
FIG. 9B is an illustration of a perspective view of the bottom portion of an exemplary embodiment of an improved boiler apparatus of the present disclosure wherein the enclosure is transparent to view interior elements within the bottom enclosure.

Additionally, the housing 103 can have coupling channels/slot 126 to allow for the vessel portion 115 to be coupled to the enclosure 103. The kettle portion can include corresponding apertures or coupling members 128 to correspond to the channels 126 as shown in FIG. 9B. The coupling members 128 in some exemplary embodiments can be fasteners that can be tightened down when the desire orientation is achieved by the user. The location of the channels 126 allow for a user to rotate the orientation of the receptacle located on the enclosure 103 in multiple locations and arrangements to provide flexibility for an end user that may have difference power source locations. A user can essentially rotate the housing 101 about 360 degrees around until the receptacle is in the desired location. This allows for multiple possibilities to orient the receptacle 112 in many angles around the kettle 15. Additionally, the ability to rotate the housing and receptacle can improve routing the heavy power cable in a desirable direction so the cable does not get in the way or result in binding of the cable when plugged into the receptacle 122. In various exemplary embodiments various coupling means can be utilized to attach the enclosure 103 to the kettle portion 115, including but not limited to the channel 126 and fasteners 128 previously presented, one or more clamping means, latching members, or permanently adhering the enclosure 103 in a desired orientation using an adhesive. The base portion 101 can include the heating element and in other embodiments, the heating element 1 can be a part of the kettle portion 115 when it is permanently bonded to the bottom surface 13 of the kettle 15.

It is understood that many combinations of multiple elements, resistances, dimensions, configurations, and bonding plate thicknesses and diameters are possible to achieve these results.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. An improved boiler apparatus comprising:

a kettle portion having an interior, an exterior surface, a bottom end having a bottom surface, a top end, and at least one valve fluidly connected to the interior; and a base portion comprising:

an enclosure having a receptacle member, an insulation member for insulating the interior cavity of the enclosure from the heating element; and a heating element assembly comprising a coil having a first diameter and a first resistance coupled to the bottom end of the kettle portion and a thermostat;

a control panel communicatively coupled to a heating coil and thermostat; and a switch communicatively coupled to the heating coil, wherein the switch is configured to adjust the voltage supplied to the heating element assembly from a first voltage to a second voltage, wherein the heating element portion is coupled to the bottom end of the kettle portion and rotatable around the kettle to provide multiple orientations of the receptacle with respect to the control panel.

2. The improved boiler apparatus of claim 1, wherein the heating element assembly further comprises a second coil having a second diameter and second resistance.

3. The improved boiler apparatus of claim 2, wherein the second resistance is greater than the first resistance.

4. The improved boiler apparatus of claim 3, wherein the second diameter is greater than the first diameter.

5. The improved boiler apparatus of claim 4, wherein the heating element assembly further comprises a third coil having a third diameter and a third resistance.

6. The improved boiler apparatus of claim 5, wherein the third diameter is greater than the second diameter.

7. The improved boiler apparatus of claim 6, wherein the third resistance is the same as the second resistance.

8. The improved boiler apparatus of claim 7, wherein the second resistance is 9 ohms.

9. The improved boiler apparatus of claim 8, wherein the first resistance is 4 ohms.

10. The improved boiler apparatus of claim 9, wherein the first voltage is 120 volts, and the second voltage is 240 volts.

11. The improved boiler apparatus of claim 1, wherein the control panel is communicatively coupled to the switch and the heating plate assembly.

12. The improved boiler apparatus of claim 11, wherein the control panel includes a transceiver.

13. The improved boiler apparatus of claim 12, wherein the control panel is coupled to the exterior of the kettle.

14. The improved boiler apparatus of claim 13, wherein the control panel includes a user interface to display information.

15. The improved boiler apparatus of claim 14, wherein the heating element portion is coupled to the bottom of the kettle portion.

16. The improved boiler apparatus of claim 15, wherein the heating element is permanently bonded to the bottom surface of the kettle portion.

17. The improved boiler apparatus of claim 10, wherein the heating element is removably couplable to the bottom surface of the kettle portion.

18. The improved boiler apparatus of claim 10, wherein the first coil, second coil, and third coil are bonded to the sub plate, wherein the subplate is comprised of aluminum and has a thickness of 5 mm, wherein the subplate is removably couplable to the bottom surface of the kettle.

19. The improved boiler apparatus of claim 16, wherein the base portion further includes aperture to access a fastener to couple the base portion to the kettle portion.

* * * * *